US007816868B2

(12) United States Patent
Kawasaki et al.

(10) Patent No.: US 7,816,868 B2
(45) Date of Patent: Oct. 19, 2010

(54) PLASMA DISPLAY PANEL WITH MAGNESIUM OXIDE FILM HAVING AN OXYGEN DEFICIENCY

(75) Inventors: Tatsuhiko Kawasaki, Miyazaki (JP); Fumiaki Yoshino, Kunitomi (JP); Atsuo Ohtomi, Miyazaki (JP); Shinichi Kameda, Kunitomi (JP)

(73) Assignee: Hitachi, Ltd., Tokyo (JP)

( * ) Notice: Subject to any disclaimer, the term of this patent is extended or adjusted under 35 U.S.C. 154(b) by 259 days.

(21) Appl. No.: 12/180,747

(22) Filed: Jul. 28, 2008

(65) Prior Publication Data

US 2009/0167174 A1 Jul. 2, 2009

(30) Foreign Application Priority Data

Dec. 28, 2007 (JP) ..... 2007-339202

(51) Int. Cl.
*H01J 17/49* (2006.01)

(52) U.S. Cl. ..... 313/582; 313/583; 313/584; 313/586

(58) Field of Classification Search ..... None
See application file for complete search history.

(56) References Cited

U.S. PATENT DOCUMENTS

| | | | | |
|---|---|---|---|---|
| 6,744,201 | B2 * | 6/2004 | Nakayama et al. | 313/582 |
| 6,783,636 | B2 * | 8/2004 | Iijima et al. | 204/192.11 |
| 2010/0079417 | A1 * | 4/2010 | Kawasaki et al. | 345/204 |

FOREIGN PATENT DOCUMENTS

| | | |
|---|---|---|
| JP | 9-185945 | 7/1997 |
| JP | 10-106441 | 4/1998 |
| JP | 11-135023 | 5/1999 |
| JP | 2000-215797 | 8/2000 |
| JP | 2001-332175 | 11/2001 |
| JP | 3247632 | 11/2001 |
| JP | 2002-358879 | 12/2002 |
| JP | 2003-100219 | 4/2003 |
| JP | 3425063 | 5/2003 |
| JP | 2006-28005 | 2/2006 |
| JP | 2006-59627 | 3/2006 |

* cited by examiner

*Primary Examiner*—Nimeshkumar D Patel
*Assistant Examiner*—Natalie K Walford
(74) *Attorney, Agent, or Firm*—Mattingly & Malur, P.C.

(57) ABSTRACT

A variation with the passage of time of a response speed is reduced. In a plasma display panel having a magnesium oxide film formed on a dielectric layer covering electrodes for gas discharge, the magnesium oxide film has an oxygen deficiency amount within a range of $3.0\times10^{17}$ to $1.0\times10^{20}$ per cubic centimeter, preferably within a range of $3.0\times10^{17}$ to $1.0\times10^{18}$ per cubic centimeter. The magnesium oxide film has a crystal orientation of (220) plane orientation.

6 Claims, 3 Drawing Sheets

PLASMA DISPLAY PANEL WITH MAGNESIUM OXIDE FILM HAVING AN OXYGEN DEFICIENCY

BACKGROUND OF THE INVENTION

1. Field of the Invention

The present invention relates to a plasma display panel having a magnesium oxide film that covers electrodes. More specifically, the present invention relates to improvement on the magnesium oxide film.

2. Description of the Related Art

In general, an AC type plasma display panel includes a magnesium oxide (MgO) film as a sputtering resistant film for protecting a dielectric layer that covers display electrodes. The magnesium oxide film is formed on the dielectric layer and is exposed in a gas discharge space. Since the magnesium oxide is a high gamma material that is apt to emit secondary electrons, the magnesium oxide film also contributes to reduction of a discharge starting voltage.

Many researches about the magnesium oxide film have been carried out for purposes of improving sputtering resistant property or improving discharge characteristics. For example, researches about crystal orientation and composition are described in Japanese Unexamined Patent Publication No. 10-106441 (Patent Document 1), Japanese Unexamined Patent Publication No. 11-135023 (Patent Document 2), Japanese Patent No. 3247632 (Patent Document 3), and Japanese Patent No. 3425063 (Patent Document 4). Patent Document 1 proposes replacing a magnesium oxide film having the (111) plane orientation with a magnesium oxide film having the (110) plane orientation, which has higher denseness than the (111) plane orientation, so that the sputtering resistant property is enhanced. Patent Document 2 describes forming a magnesium oxide film having the (110) plane orientation by a plasma CVD method. Patent Document 3 discloses a magnesium oxide film containing an element having a valence of three and an ionic radius that is similar to that of magnesium (e.g., silicon) is useful for reducing addressing errors causing no address discharge. In Patent Document 3, the reason why addressing errors can be reduced is understood to be that the contained element as impurities increases emission of secondary electrons. Patent Document 4 discloses a magnesium oxide film of (n00) plane orientation or (mm0) plane orientation (n and m are integers larger than or equal to one) in which six coordination impurity ion (selected from a group consisting of Fe, Ni, Co, V, Mn, Cr, Ru, Ti, Ta, Pd, Al, Rh, Sb and Nb) similar to magnesium is doped for enabling emission of more secondary electrons.

In addition, Japanese Unexamined Patent Publication No. 2006-28005 (Patent Document 5) describes improvement on film quality in which attention is focused on oxygen deficiency in a magnesium oxide film. This document specifies a desirable oxygen deficiency amount for reducing temperature dependence of a response time at a temperature within a range of −15 to 90 degrees centigrade, which is a value within a range of $5.0\times10^{15}$ to $2.0\times10^{17}$ per cubic centimeter. Here, the oxygen deficiency amount described in this document is an amount that is calculated from a total number of F center and $F^+$ center measured by the electron spin resonance (ESR) method, and the response time is a period from application of voltage that causes a discharge to a time point when near infrared rays emitted by the discharge is undetectable (an end of light emission).

A decrease of response speed is known as a variation with the passage of time of a plasma display panel. That is, as an accumulative time of a display increases in a plasma display panel, a delay of discharge with respect to application of a voltage pulse for generating the discharge becomes conspicuous. The response speed is an indicator of a degree of the delay of discharge. This variation with the passage of time of a plasma display panel is possibly related to a certain change of the magnesium oxide film, but a cause of the change is not determined clearly.

Voltage waveforms for driving a plasma display panel incorporate the above-mentioned decrease of response speed when the plasma display panel is designed. If there is no or little decrease of response speed, a pulse width of the voltage pulse can be a minimum value adapted to an initial response speed or a value close to the minimum value. In reality, however, the response speed will decrease by approximately 30% after accumulative time of use of 20,000 hours, for example. Therefore, the pulse width is selected to be a longer value corresponding to an estimated decrease of response speed so that a discharge can be generated normally even if the response speed is decreased.

It is desired to decrease the pulse width particularly from a viewpoint of increasing an addressing speed. If a pulse width of an address pulse for generating an address discharge can be shorter than that in the current situation, the number of address pulses that can be applied in a limited period can be increased. Then, it becomes possible to display with higher resolution having more display lines. Alternatively, it is possible to enhance a luminance of display by increasing the number of display discharges corresponding to the decrease in time period necessary for addressing. In order to decrease the pulse width, it is necessary to improve the variation with the passage of time of the response speed.

SUMMARY OF THE INVENTION

It is an object of the present invention to provide a plasma display panel having little variation with the passage of time of the response speed.

A plasma display panel according to an embodiment of the present invention has a magnesium oxide film formed on a dielectric layer that covers electrodes for gas discharge. The magnesium oxide film has an oxygen deficiency amount within a range of $3.0\times10^{17}$ to $1.0\times10^{20}$ per cubic centimeter.

In a preferred embodiment, the magnesium oxide film has an oxygen deficiency amount within a range of $3.0\times10^{17}$ to $1.0\times10^{18}$ per cubic centimeter.

In a more preferred embodiment, the magnesium oxide film has a crystal orientation of (220) plane orientation.

According to the structure described above, a quantity of variation with the passage of time of the response speed can be reduced.

BRIEF DESCRIPTION OF THE DRAWINGS

These and other features, objects and advantages of the present invention will become more apparent from the following description when taken in conjunction with the accompanying drawings.

DESCRIPTION OF THE PREFERRED EMBODIMENTS

Figure 1:
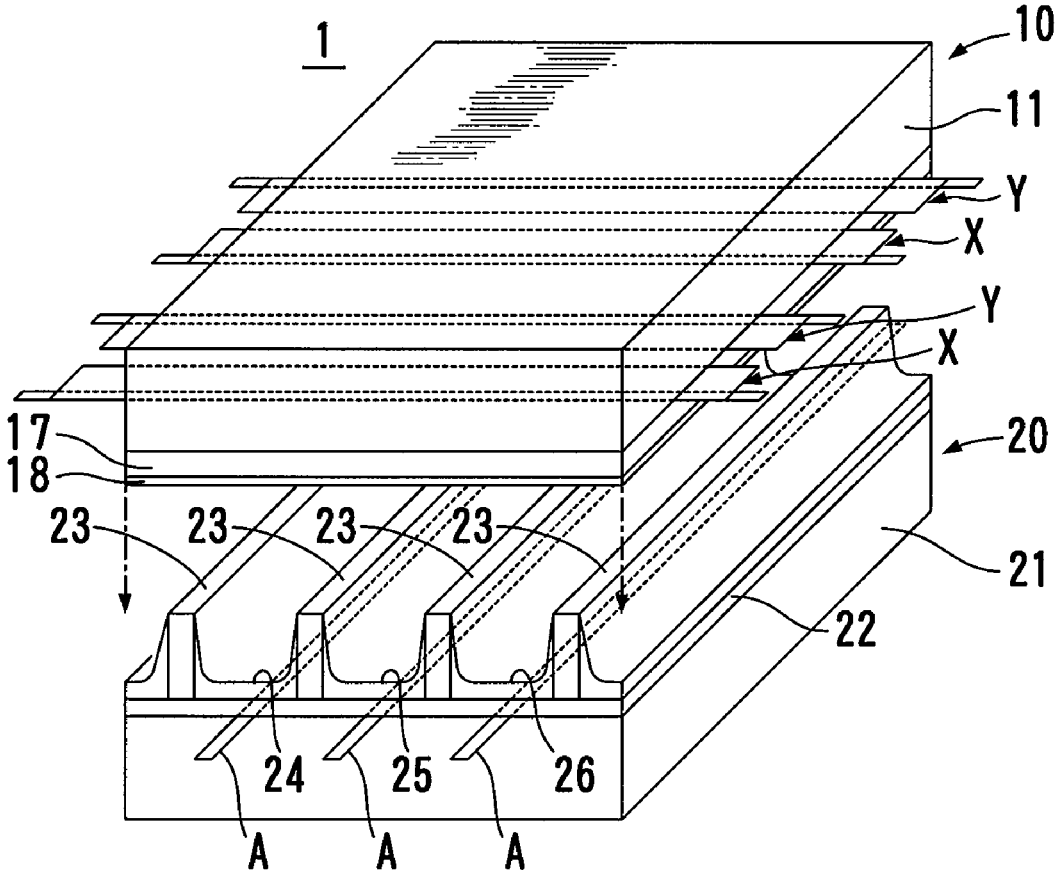
FIG. 1 PRIOR ART
FIG. 1 is an exploded perspective view showing an example of a cell structure of a plasma display panel according to an embodiment of the present invention.

An example of a structure of a plasma display panel according to an embodiment of the present invention is shown in FIG. 1. A plasma display panel 1 shown in FIG. 1 has a typical three-electrode surface discharge structure including a front plate 10 and a rear plate 20. In FIG. 1, the front plate 10 and the rear plate 20 are shown in a separate manner for easy understanding of the inner structure. Display electrodes X and display electrodes Y are arranged on a glass substrate 11 included in the front plate 10, so that a display discharge of a surface discharge type can be generated. These electrodes are covered with a dielectric layer 17, and a magnesium oxide film 18 as a sputtering resistant film called a protection film is formed on the dielectric layer 17. The rear plate 20 that is opposed to the front plate 10 includes a glass substrate 21, address electrodes A, a dielectric layer 24, a plurality of partitions 23, a red (R) fluorescent material 24, a green (G) fluorescent material 25, and a blue (B) fluorescent material 26. The internal space defined by the partitions 23 is filled with discharge gas.

The plasma display panel 1 has a characteristic structure, in which an oxygen deficiency amount of the magnesium oxide film 18 is selected to be equal to or larger than $3.0\times10^{17}$ per cubic centimeter. Since this magnesium oxide film 18 is exposed in a gas discharge space as the protection film, a variation with the passage of time of a response speed can be suppressed.

An ion plating method and an electron beam vapor deposition method are suitable for forming the magnesium oxide film 18. It is known that the oxygen deficiency amount and a crystal orientation can be controlled by controlling a temperature of the substrate, a pressure, and components of atmosphere (oxygen, hydrogen and water) under film formation.

As an example, the magnesium oxide film having a thickness of approximately 1 micron was formed on the dielectric layer 17 made of low melting point glass by using the ion plating method. A plurality of front plates were made by setting a temperature for heating the substrate to a value within a range of 100 to 300 degrees centigrade, and adjusting a film forming pressure within a range of $2.0\times10^{-3}$ to $4.0\times10^{-4}$ hectopascals, an oxygen partial pressure within a range of $1.3\times10^{-3}$ to $1.3\times10^{-4}$ hectopascals, a hydrogen partial pressure within a range of $1.3\times10^{-3}$ to $1.3\times10^{-5}$ hectopascals, and a water partial pressure within $1.3\times10^{-3}$ to $1.3\times10^{-5}$ hectopascals, respectively. These front plates were made under different conditions for forming the magnesium oxide film, but other structures of them were the same as each other. At the same time when the magnesium oxide film was formed for making the front plates, a magnesium oxide film was formed also on a small substrate as a test sample for obtaining an analysis sample of film quality. Each of the front plates was glued to the rear plate that has been made separately so that the plasma display panel was manufactured. The response speed of the manufactured plasma display panel was measured, and the oxygen deficiency amount and the crystal orientation of the magnesium oxide film as the test sample were measured.

The measurement of the oxygen deficiency amount was performed by using the electron spin resonance (ESR) method in the same manner as the method disclosed in Patent Document 5. Therefore, the measured amount corresponds to a total number of F center and $F^+$ center. The F center means the state in which two electrons are trapped in the oxygen deficiency part, and the $F^+$ center means the state in which one electron is trapped in the same. The F center showing no paramagnetism cannot be measured directly by using the ESR method. Therefore, the number of $F^+$ centers was determined by utilizing an action that the F center changes into the $F^+$ center when an electron is excited by projection of ultraviolet rays, based on an ESR signal before and after the projection of ultraviolet rays.

The measurement of the crystal orientation was performed by using a plane X-ray diffractometer (XRD).

Table 1 shows a result of the measurement of the initial response speed of the plasma display panel in which the oxygen deficiency amount of the magnesium oxide film was controlled. In Table 1, the initial response speed is indicated by a relative value that is normalized by setting the value of Reference example 1 to be one. In addition, FIG. 2 shows a relationship between the oxygen deficiency amount and the initial response speed of each of Examples 1 to 9 and Reference examples 1 to 3 shown in Table 1.

TABLE 1

| | Oxygen deficiency number [/cm$^3$] | Orientation | Initial response speed [relative value] |
|---|---|---|---|
| Example 1 | $3.0\times10^{17}$ | (111), (220) | 0.97 |
| Example 2 | $4.4\times10^{17}$ | (220) | 1.05 |
| Example 3 | $5.0\times10^{17}$ | (220) | 1.05 |
| Example 4 | $5.1\times10^{17}$ | (220) | 1.02 |
| Example 5 | $5.5\times10^{17}$ | (111), (220) | 0.88 |
| Example 6 | $7.7\times10^{17}$ | (220) | 0.76 |
| Example 7 | $1.1\times10^{18}$ | (111) | 0.85 |
| Example 8 | $1.2\times10^{18}$ | (111) | 0.87 |
| Example 9 | $1.6\times10^{18}$ | (111) | 0.94 |
| Reference example 1 | $2.6\times10^{17}$ | (111) | 1.00 |
| Reference example 2 | $2.6\times10^{17}$ | (111) | 1.04 |
| Reference example 3 | $1.1\times10^{17}$ | (111) | 0.90 |

Figure 2:
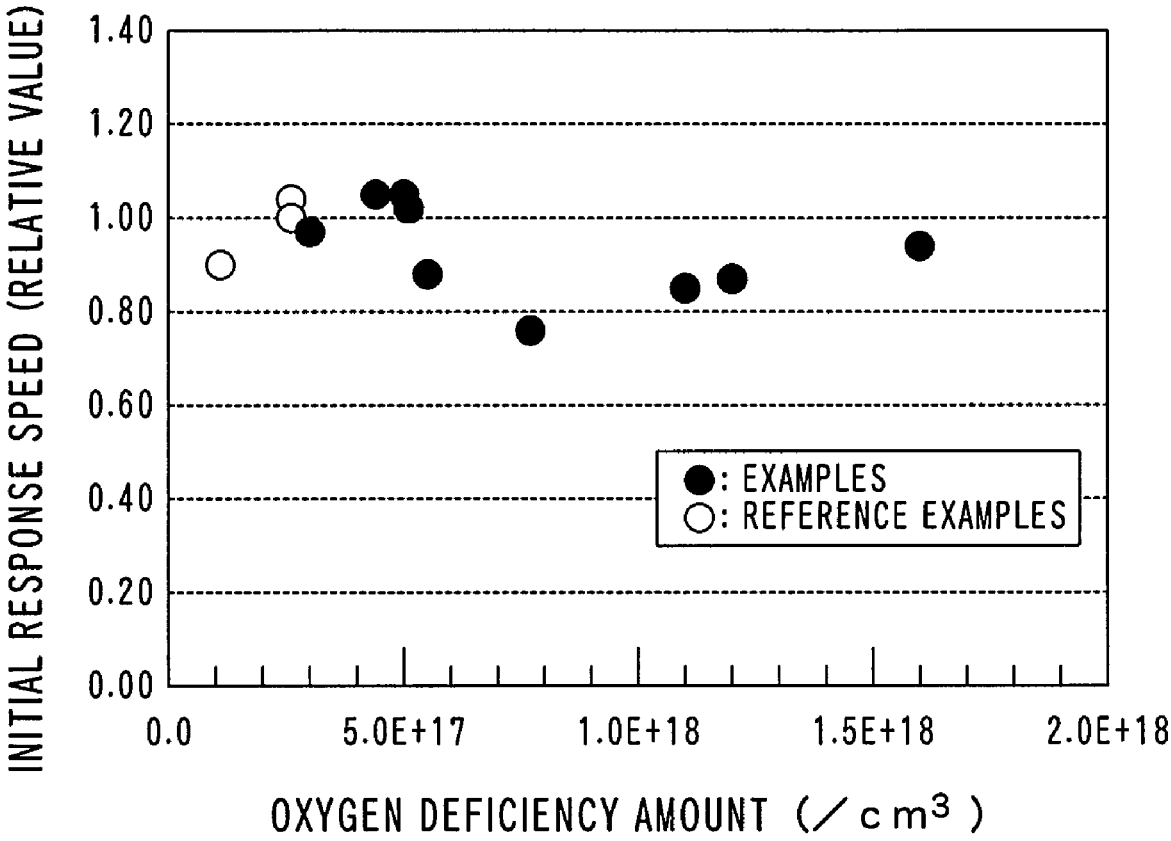
FIG. 2 is a graph showing a relationship between an oxygen deficiency amount of a magnesium oxide film and an initial response speed.

As shown in Table 1 and FIG. 2, there is no substantial difference in the initial response speed in the range of the oxygen deficiency amount within $1.1\times10^{17}$ per cubic centimeter (Reference example 3) to $1.6\times10^{18}$ per cubic centimeter (Example 9). The reason is considered to be that although an emission quantity of the secondary electrons increases with an increase in the oxygen deficiency amount if the oxygen deficiency amount is relatively small, the emission action of the secondary electrons will be saturated when the oxygen deficiency amount becomes a certain value or more.

Among the examples shown in Table 1, plasma display panels having substantially different oxygen deficiency amounts were selected for a lighting life test. In order to decrease the evaluation time period, an accelerated test was performed in which the drive frequency was set to 60 kHz that is three to six times as large as that under the normal conditions. The lighting time period of the lighting life test corresponds to a display for 20,000 hours of accumulative time in the normal use. The variation quantity of the response speed between before and after the lighting life test is shown in Table 2 and FIG. 3. The variation quantity is a ratio of the difference of a value before the test with respect to a value after the test. For example, the variation quantity 0.4 means that a discharge delay time after the test is 1.4 times as large as that before the test.

TABLE 2

| | Oxygen deficiency number [/cm$^3$] | Response speed variation [relative value] | Orientation | Refractive index |
|---|---|---|---|---|
| Example 1 | $3.0 \times 10^{17}$ | 0.40 | (111), (220) | 1.71 |
| Example 2 | $4.4 \times 10^{17}$ | 0.29 | (220) | 1.71 |
| Example 3 | $5.0 \times 10^{17}$ | 0.38 | (220) | 1.71 |
| Example 4 | $5.1 \times 10^{17}$ | 0.25 | (220) | 1.71 |
| Example 5 | $5.5 \times 10^{17}$ | 0.34 | (111), (220) | 1.70 |
| Example 6 | $7.7 \times 10^{17}$ | 0.33 | (220) | 1.69 |
| Reference example 1 | $2.6 \times 10^{17}$ | 0.42 | (111) | 1.62 |
| Reference example 3 | $1.1 \times 10^{17}$ | 0.42 | (111) | 1.63 |

Figure 3:
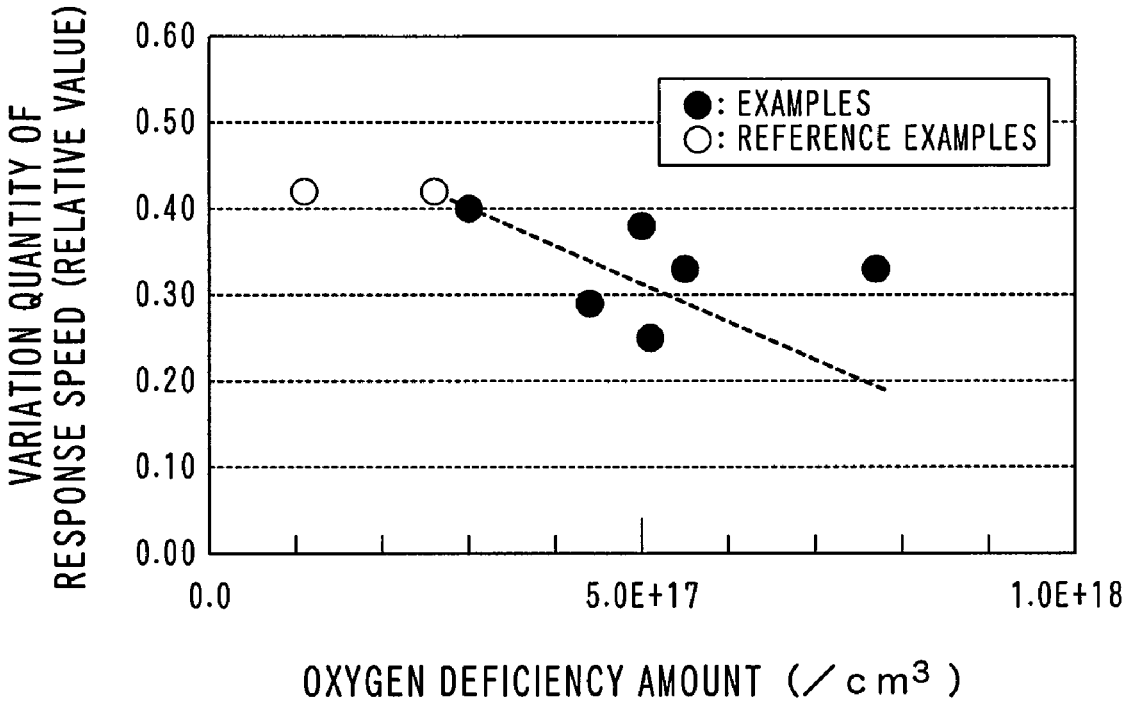
FIG. 3 is a graph showing a relationship between an oxygen deficiency amount of a magnesium oxide film and a variation quantity of a response speed.

As shown in Table 2 and FIG. 3, it is understood that the variation quantity of the response speed is smaller as the oxygen deficiency amount is larger. Since the variation quantity of the Reference example 1, which has the oxygen deficiency amount of $2.6\times10^{17}$ per cubic centimeter that is the same level as $2.0\times10^{17}$ per cubic centimeter of the upper limit described in Patent Document 5, is 0.4, it is effective to set the oxygen deficiency amount to a value of $3.0\times10^{17}$ per cubic centimeter or larger in order to improve the variation with the passage of time of the response speed. However, if the oxygen deficiency amount is increased extremely to an extent that it exceeds 0.1% of the maximum number of atoms of the crystal (usually, $1.0\times10^{23}$ per cubic centimeter), for example, distortion of the crystal may occur. Therefore, it is necessary to restrict the value to $1.0\times10^{20}$ per cubic centimeter or smaller at most. In other words, the oxygen deficiency amount should be controlled to be a value within a range of $3.0\times10^{17}$ to $1.0\times10^{20}$ per cubic centimeter.

Here, the reason why the response speed is improved by increasing the oxygen deficiency amount will be described. The discharge delay time that determines the response speed can be divided into two components of a statistical delay time and a formation delay time. The statistical delay time means a time period from an application of a voltage until a generation of a first electron. The formation delay time means a time period from the generation of a first electron until a formation of discharge. The statistical delay time is affected largely by a priming effect. More specifically, if the time from the previous discharge lasts long, priming particles decrease so that the statistical delay time increases. It is found that the magnesium oxide forms an electron emission level due to the oxygen deficiency in the band gap, and the oxygen deficiency works as a source of the priming particles. The reason why the response speed is decreased by the lighting life test is considered to be that a crystal structure of the magnesium oxide is destroyed by an ion impact due to the discharge resulting in a decrease of the number of oxygen deficiencies. Therefore, it is estimated that if the number of oxygen deficiencies of the magnesium oxide is increased intentionally in advance, the oxygen deficiencies as the sources of the priming particles are compensated even after the ion impact due to the discharge so that the initial response speed can be maintained substantially.

However, since the oxygen deficiency is a structural defect, the increase in the oxygen deficiencies may enlarge a distortion of a crystal lattice resulting in a deterioration of the sputtering resistant property even if it is not increased extremely as described above. Therefore, it is probably effective to adopt the (220) plane orientation that is chemically more stable than the (111) plane orientation that is adopted generally so that the deterioration of the sputtering resistant property can be suppressed.

Comparing the refractive index values of the magnesium oxide films of the individual examples shown in Table 2 with each other, it is found that the refractive index is increased when the (220) plane orientation is adopted. Since the refractive index reflects a density of the film, the film of the (220) plane orientation has a larger density than the film of the (111) plane orientation and is superior in the sputtering resistant property to the same.

On the other hand, the increase in the number of oxygen deficiencies may cause a rise of the discharge voltage when a running PDP has a high temperature. Therefore, three plasma display panels having different oxygen deficiency amounts were selected from among the examples shown in Table 1 and were tested for a high temperature margin characteristic. A difference ΔVsmin between the sustain voltage that generates a display discharge at 25 degrees centigrade and the sustain voltage that generates a display discharge at 80 degrees centigrade is shown in Table 3. It was confirmed that an increase in an operating voltage becomes large at $1.1\times10^{18}$ per cubic centimeter or its vicinity of Example 8. When a margin of the sustain voltage that depends on an operating temperature is set to 8 volts, it is desirable to set the upper limit of the oxygen deficiency amount to $1.0\times10^{18}$ per cubic centimeter.

TABLE 3

| | Oxygen deficiency number [/cm$^3$] | High temperature margin characteristic ΔVsmin. (25 → 80° C.) |
|---|---|---|
| Example 3 | $5.0 \times 10^{17}$ | 2.4 V |
| Example 8 | $1.1 \times 10^{18}$ | 8.0 V or higher |
| Reference example 1 | $2.6 \times 10^{17}$ | 3.4 V |

While we have shown and described several embodiments in accordance with our invention, it should be understood that disclosed embodiments are susceptible of changes and modifications without departing from the scope of the invention. Therefore, we do not intend to be bound by the details shown and described herein but intend to cover all such changes and modifications within the ambit of the appended claims.

What is claimed is:

1. A plasma display panel having a magnesium oxide film formed on a dielectric layer that covers electrodes for gas discharge, the magnesium oxide film having an oxygen deficiency amount within a range of $3.0\times10^{17}$ to $1.0\times10^{20}$ per cubic centimeter.

2. The plasma display panel according to claim 1, wherein the magnesium oxide film has an oxygen deficiency amount within a range of $3.0\times10^{17}$ to $1.0\times10^{18}$ per cubic centimeter.

3. The plasma display panel according to claim 2, wherein the magnesium oxide film has a crystal orientation of (220) plane orientation.

4. A plasma display panel comprising:

a front substrate;

display electrodes formed on the front substrate;

a dielectric layer formed on the front substrate to cover the display electrodes; and a magnesium oxide film formed on the dielectric layer, the magnesium oxide film having an oxygen deficiency amount within a range of $3.0\times10^{17}$ to $1.0\times10^{20}$ per cubic centimeter.

5. The plasma display panel according to claim 4, wherein the magnesium oxide film has an oxygen deficiency amount within a range of $3.0\times10^{17}$ to $1.0\times10^{18}$ per cubic centimeter.

6. The plasma display panel according to claim 5, wherein the magnesium oxide film has a crystal orientation of (220) plane orientation.

* * * * *